US007278272B2

(12) United States Patent
Huston et al.

(10) Patent No.: US 7,278,272 B2
(45) Date of Patent: Oct. 9, 2007

(54) MARINE AIR CONDITIONER DECONTAMINATION SYSTEM

(75) Inventors: Trevor Lee Huston, Venice, FL (US); Robert Scheir, Sherman Oaks, CA (US); Robert Culbert, Manhattan Beach, CA (US)

(73) Assignee: Steril-Aire, Inc., Burbank, CA (US)

( * ) Notice: Subject to any disclaimer, the term of this patent is extended or adjusted under 35 U.S.C. 154(b) by 233 days.

(21) Appl. No.: 11/165,415

(22) Filed: Jun. 22, 2005

(65) Prior Publication Data

US 2005/0236013 A1 Oct. 27, 2005

Related U.S. Application Data

(60) Continuation-in-part of application No. 10/898,433, filed on Jul. 23, 2004, now Pat. No. 7,140,749, and a continuation-in-part of application No. 10/849,073, filed on May 18, 2004, and a continuation-in-part of application No. 10/648,101, filed on Aug. 25, 2003, and a continuation-in-part of application No. 10/426,339, filed on Apr. 29, 2003, which is a continuation of application No. 10/223,433, filed on Aug. 19, 2002, now Pat. No. 6,627,000, which is a continuation of application No. 09/373,955, filed on Aug. 13, 1999, now Pat. No. 6,589,476, which is a division of application No. 09/167,376, filed on Oct. 6, 1998, now Pat. No. 6,500,267, which is a continuation-in-part of application No. 08/803,350, filed on Feb. 20, 1997, now Pat. No. 5,817,276.

(51) Int. Cl.
*F25D 27/00* (2006.01)

(52) U.S. Cl. ..... 62/78; 62/240; 62/264

(58) Field of Classification Search ..... 62/78, 62/264, 240
See application file for complete search history.

(56) References Cited

U.S. PATENT DOCUMENTS 2,757,305 A 7/1956 Dziergwa (Continued)

FOREIGN PATENT DOCUMENTS

WOWO9517634 / 5891399 6/1995

OTHER PUBLICATIONS

Nagle, "The How and Why of Electric Noses", IEEE Spectrum, Sep. 1998, pp. 22-34.

(Continued)

*Primary Examiner*—William E. Tapolcai
(74) *Attorney, Agent, or Firm*—SoCal IP Law Group LLP; Steven C. Sereboff; John E. Gunther

(57) ABSTRACT

There is disclosed a marine air conditioning system and a process for cleaning and maintaining the marine air conditioning system. The marine air conditioning system may comprise a marine air conditioner, a bracket and a germicidal lamp. The marine air conditioner may comprise an evaporator coil and a drain pan. The evaporator coil may include a surface. The drain pan may be disposed below the evaporator coil. The bracket may be attacked to the marine air conditioner. The germicidal lamp may be upstream of the evaporator coil. The germicidal lamp may receive mechanical support from the bracket. The germicidal lamp may be adapted to emit ultraviolet radiation at a wavelength substantially at 253.7 nm towards the surface and the drain pan and generate an insignificant quantity or less of ozone.

33 Claims, 13 Drawing Sheets

U.S. PATENT DOCUMENTS

| | | | | | |
|---|---|---|---|---|---|
| 3,550,782 | A | | 12/1970 | Veloz | |
| 3,576,593 | A | | 4/1971 | Cicirello | |
| 4,227,446 | A | | 10/1980 | Sone | |
| 4,245,550 | A | | 1/1981 | Suzuki | |
| 4,637,223 | A | | 1/1987 | Hosoya | |
| 4,990,313 | A | * | 2/1991 | Pacosz | 96/224 |
| 5,112,370 | A | | 5/1992 | Gazzano | |
| 5,151,135 | A | | 9/1992 | Magee | |
| 5,219,534 | A | | 6/1993 | Reynolds | |
| 5,322,569 | A | | 6/1994 | Titus | |
| 5,334,347 | A | * | 8/1994 | Hollander | 422/24 |
| 5,453,049 | A | | 9/1995 | Tillman | |
| 5,523,057 | A | | 6/1996 | Mazzilli | |
| 5,547,635 | A | * | 8/1996 | Duthie, Jr. | 422/24 |
| 5,558,158 | A | * | 9/1996 | Elmore | 165/122 |
| 5,612,001 | A | | 3/1997 | Matschke | |
| 5,742,063 | A | | 4/1998 | Scroggins | |
| 5,755,103 | A | | 5/1998 | Na | |
| 5,817,276 | A | | 10/1998 | Fencl | |
| 5,848,536 | A | | 12/1998 | Dodge | |
| 5,894,130 | A | | 4/1999 | Bach | |
| 5,902,552 | A | | 5/1999 | Brickley | |
| 5,916,439 | A | * | 6/1999 | Oleskow | 210/198.1 |
| 5,924,300 | A | | 7/1999 | Fromm | |
| 5,933,702 | A | | 8/1999 | Goswami | |
| 6,193,939 | B1 | | 2/2001 | Kozlowski | |
| 6,221,314 | B1 | | 4/2001 | Bigelow | |
| 6,245,293 | B1 | | 6/2001 | Fencl | |
| 6,267,924 | B1 | | 7/2001 | Fencl | |
| 6,280,686 | B1 | | 8/2001 | Scheir | |
| 6,313,470 | B1 | | 11/2001 | Fencl | |
| 6,379,427 | B1 | | 4/2002 | Siess | |
| 6,500,267 | B1 | | 12/2002 | Fencl | |
| 6,557,356 | B2 | * | 5/2003 | Underwood | 62/78 |
| 6,576,188 | B1 | | 6/2003 | Rose | |
| 6,580,228 | B1 | | 6/2003 | Chen | |
| 6,589,486 | B1 | | 7/2003 | Spanton | |
| 6,619,063 | B1 | * | 9/2003 | Brumett | 62/264 |
| 6,653,647 | B1 | | 11/2003 | Vilarasau Alegre | |
| 6,782,707 | B2 | | 8/2004 | Shindo | |
| 2002/0098109 | A1 | | 7/2002 | Nelson | |
| 2002/0174674 | A1 | | 11/2002 | Takahashi | |
| 2003/0000229 | A1 | | 1/2003 | Underwood | |
| 2004/0141875 | A1 | * | 7/2004 | Doshi | 422/4 |
| 2004/0161371 | A1 | | 8/2004 | Russell | |
| 2004/0208798 | A1 | | 10/2004 | Splane | |

OTHER PUBLICATIONS

Burge, H.A., Ph.D., "Approaches to the Control of Indoor Microbial Contamination", Presented at Ashrae IAQ.

Garrison, R.A.. Robertson, L.D.. Doehn, R.D. Ph.D.. and Wynn, S.R. M.D., "Effect of Heating-Ventilation-Air Conditioning System Sanitation on Airborne Fungal Population in Residential Environments".

"Introducing the Ultra Germicidal Air Probe Sanitizer".

"Ultraviolet Air Purification," Specialized Ventilation Systems.

Burge, H.A., Ph.D., "Approaches to the Control of Indoor Microbial Contamination", Presented at Ashrae IAQ, May 1987.

Garrison, R.A.. Robertson, L.D., Doehn, R.D. Ph.D.. and Wynn, S.R. M.D., "Effect of Heating-Ventilation-Air Conditioning System Sanitation on Airborne Fungal Population in Residential Environments", Dec. 1993.

"Introducing the Ultra Germicidal Air Probe Sanitizer", Sep. 1996.

* cited by examiner

MARINE AIR CONDITIONER DECONTAMINATION SYSTEM

RELATED APPLICATION INFORMATION

This application is a continuation-in-part of application Ser. No. 10/648,101 filed Aug. 25, 2003 the disclosure of which is incorporated herein by reference, which is a continuation of application Ser. No. 10/223,433 filed Aug. 19, 2002 now U.S. Pat. No. 6,627,000, which is a division of application Ser. No. 09/167,376 filed Oct. 6, 1998 now U.S. Pat. No. 6,500,267, which is a continuation-in-part of application Ser. No. 08/803,350 filed Feb. 20, 1997 now U.S. Pat. No. 5,817,276. This application is a continuation-in-part of application Ser. No. 10/426,339 filed Apr. 29, 2003 the disclosure of which is incorporated herein by reference, which is a continuation of application Ser. No. 09/373,955 filed Aug. 13, 1999 now U.S. Pat. No. 6,589,476. This application is a continuation-in-part of application Ser. No. 10/849,073 filed May 18, 2004 the disclosure of which is incorporated herein by reference. This application is a continuation-in-part of application Ser. No. 10/898,433 filed Jul. 23, 2004, now U.S. Pat. No. 7,140,749, the disclosure of which is incorporated herein by reference.

NOTICE OF COPYRIGHT AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

The present invention relates to marine air conditioner decontamination.

2. Description of the Related Art

Recreational boating is very popular. The U.S. Coast Guard has estimated that there are over 20 million recreational boats in the United States. Recreational boats are commonly used for fishing, water skiing, sailing and cruising. At least 10 percent of recreational boats include a cabin. Cabins typically include a bunk, a lavatory and a kitchen.

In general, the warmest place on a boat is inside the cabin. Heat is generated by solar radiation, conduction, appliances, people and pets. Many recreational boats are now manufactured with air conditioning systems. After market air conditioners are also widely available. Air conditioning units specifically designed for marine use are referred to as marine air conditioners. A marine air conditioner may be cooled with water from a lake, sea, ocean or other body of water. A typical marine air conditioner includes corrosion protection from salt water.

Marine air conditioners are manufactured in a variety of configurations and capacities. A self contained unit may include a compressor and an evaporator coil in a single package. A central unit may include a single compressor which feeds several remote evaporator coils, each located in a different room. Some larger recreational boats include multiple units working in tandem. Designed for creature comfort, modem marine air conditioners operate quietly and with high efficiency. Efficient evaporator coils generate condensation. In high humidity conditions, it is common that a marine air conditioner may produce more than 1 liter of condensation per hour.

DETAILED DESCRIPTION OF THE INVENTION

Throughout this description, the embodiments and examples shown should be considered as exemplars, rather than limitations on the apparatus and methods of the present invention.

Many of today's marine vehicles are equipped with heat, ventilation and air conditioning (HVAC) systems. One aspect of a modem HVAC system is the efficient control of air quality within the passenger cabin.

Efficiency is related to the amount of power required to perform HVAC functions, for example, heating, cooling, humidifying, dehumidifying, filtering and decontaminating air that is transferred to and from the passenger cabin. As efficiencies are improved, the operating costs of the HVAC system and in turn, the marine vehicle are reduced. Moreover, since less energy is required to power efficient HVAC systems, less fuel is burned, resulting in lower emissions.

Figure 1:
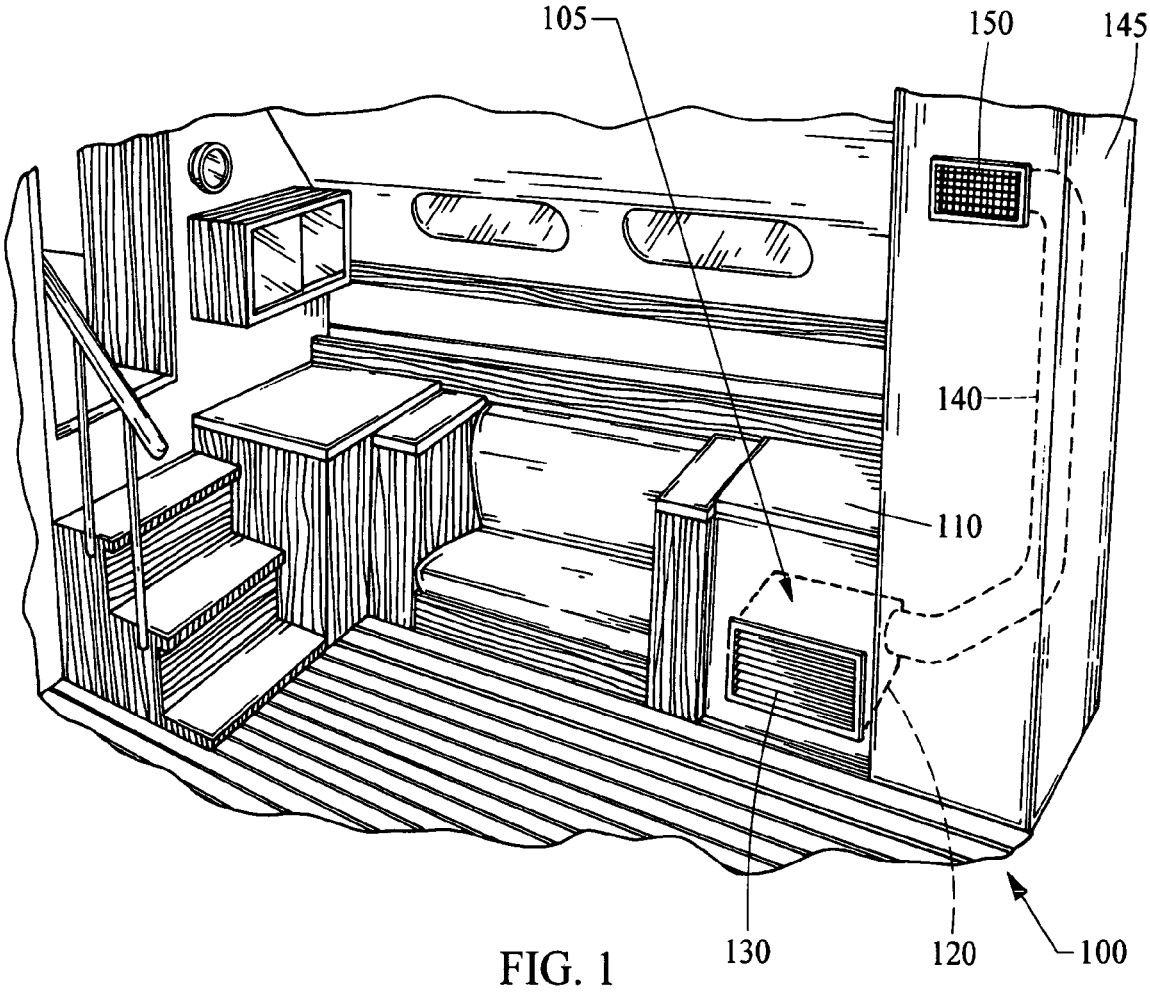
FIG. 1 is a partial plan view of a cabin.

Referring now to FIG. 1, there is shown a partial plan view of a cabin 100. The cabin 100 may be a small room on a marine vehicle providing private accommodations for one or more persons. The cabin 100 may be a compartment at least partially above and/or below deck for passengers or crew on a marine vehicle. A marine vehicle may be a boat, a yacht, a ship, a submersible, an amphibious vehicle or other vessel. The marine vehicle may include a hull.

The cabin 100 may include an HVAC system 105. The HVAC system may include a return air grille 130, an air conditioner 120, a duct 140 and a supply air grille 150. The HVAC system 105 may provide cooling and/or dehumidification to the air within the cabin 100 in order to make recreational boating more pleasurable.

The term grille refers to a covering which includes a barrier and an opening to control the passing of a fluid such as air to or from an HVAC system. A grille may include a grating, a slot, a slit, a hole, a screen or other design. A grille may include functional as well as aesthetic qualities. Air may enter the HVAC system 105 via the return air grille 130. The return air grille 130 may be disposed external to or within the cabin 100. The return air grille 130 may be located in an inconspicuous location, for example, underneath a cabinet 110, a dinette, a bed, a sofa, a berth, a helm station or other location. The return air grille 130 may be manufactured from a variety of materials, for example, metal, plastic, wood or other material. The dimensions of the return air grille 130 may be selected based on amount of air that the air conditioner 120 requires. The return air grille 130 may be 10" long by 10" high by ⅛" thick or other dimensions. The return air grille 130 may prevent large objects from passing into the HVAC system 105. If large objects pass into to the HVAC system 105, the HVAC system 105 may prematurely fail or run inefficiently.

An air conditioner is a device which modifies the heat and/or the moisture content of air. The air conditioner 120 may be powered electrically via a power generator (not shown), a vehicle's power system (not shown), an alternator (not shown), a hookup to dock power (not shown) or other power source. The air conditioner 120 may be hidden behind the return air grille 130. The air conditioner 120 may be located remote to the cabin 100. The air conditioner 120 may be disposed in a window (not shown) of the cabin. The air conditioner 120 may receive air which passes through the return air grille. The air conditioner 120 may remove heat and/or moisture from the air. The air conditioner 120 may supply the conditioned air to the cabin 100 via the duct 140 and the supply air grille 150. The air conditioner 130 may provide conditioned air directly into the cabin 100.

A duct is a pipe, tube or channel through which a fluid may pass. The duct 140 may be flexible, rigid and/or insulated. The duct 140 may be hidden within a wall 145, below the floor (not shown) or in the ceiling (not shown). The duct 140 may be disposed conspicuously within the cabin 100 or disposed in another location. Conditioned air may pass from the duct 140 through the supply air grille 150 into the cabin 100. The supply air grille may prevent large objects from passing into the HVAC system 105.

The supply air grille 150 may be disposed near the top of the cabin 100 as cooler conditioned air may fall through the cabin. The return air grill 150 may be integral to the air conditioner 130.

Figure 2:
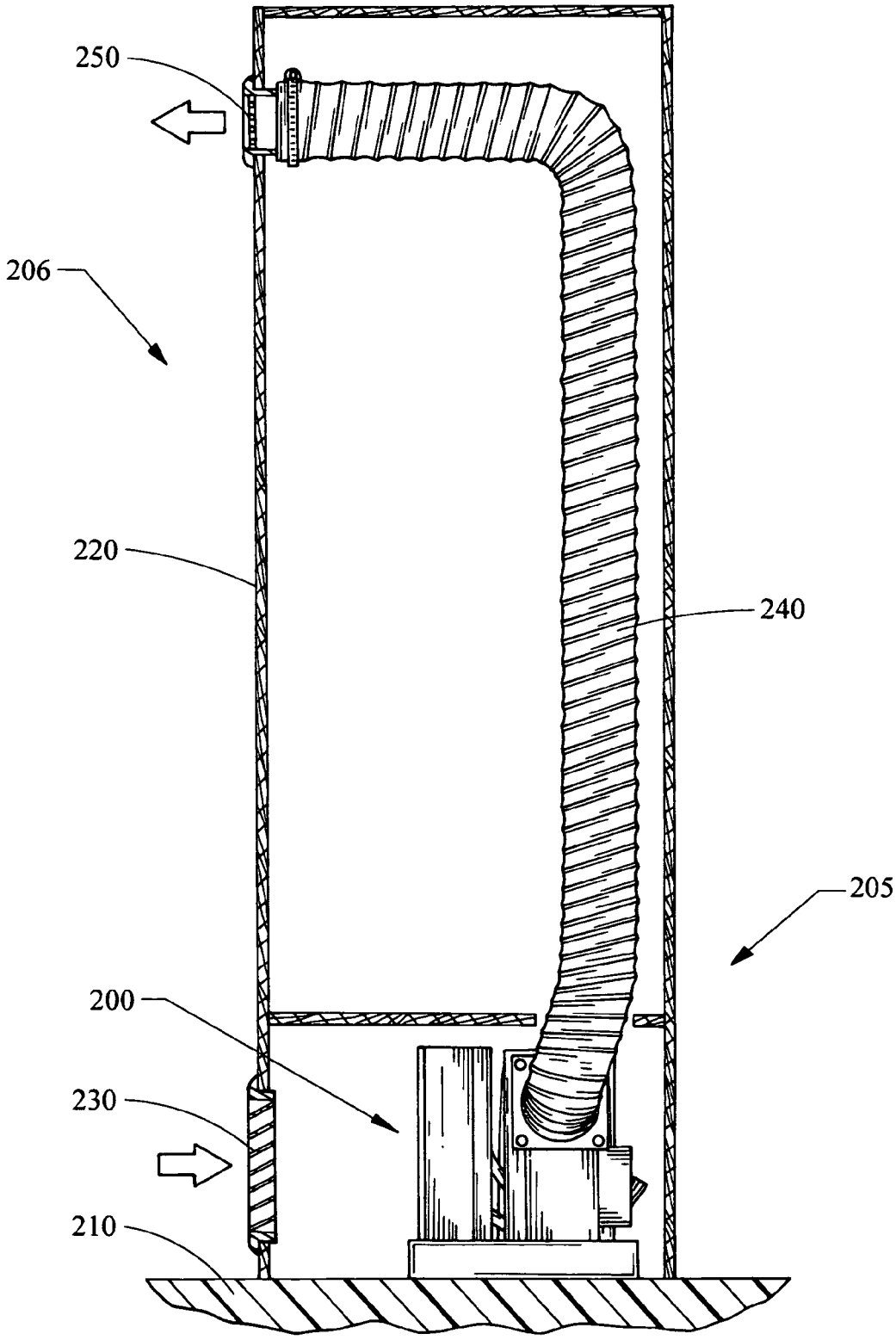
FIG. 2 is a perspective view of a marine air conditioner.

Referring now to FIG. 2, there is shown a perspective view of a marine air conditioning system 205. The marine air conditioning system 205 may include a return air grille 230, a marine air conditioner 200, a duct 240 and a supply air grille 250. The marine air conditioner 200 may be installed behind a wall 220 of a cabin 206. The marine air conditioner 230 may be installed in a hidden location to promote aesthetics within the cabin 206. The wall 200 may be any wall of the cabin 206. The marine air conditioner 200 may be disposed on a floor 210. The floor 210 may be the floor of the cabin 206, a pedestal of the cabin 206, or any other horizontal surface within the cabin 206. The marine air conditioner 200 may be attached to or mounted to the floor 210. The marine air conditioner 200 may be affixed to a wall (not shown) via brackets (not shown), straps (not shown), a shelf (not shown) or other support. The marine air conditioner 200 may be disposed at a distance behind the return air grille 230. For example, the marine air conditioner 200 may be 3", 12", 20" or other distance behind the return air grille 230. The distance between the marine air conditioner 200 and the return air grille 230 may be based on the spatial constraints inside the cabin and behind the wall 220.

Figure 3:
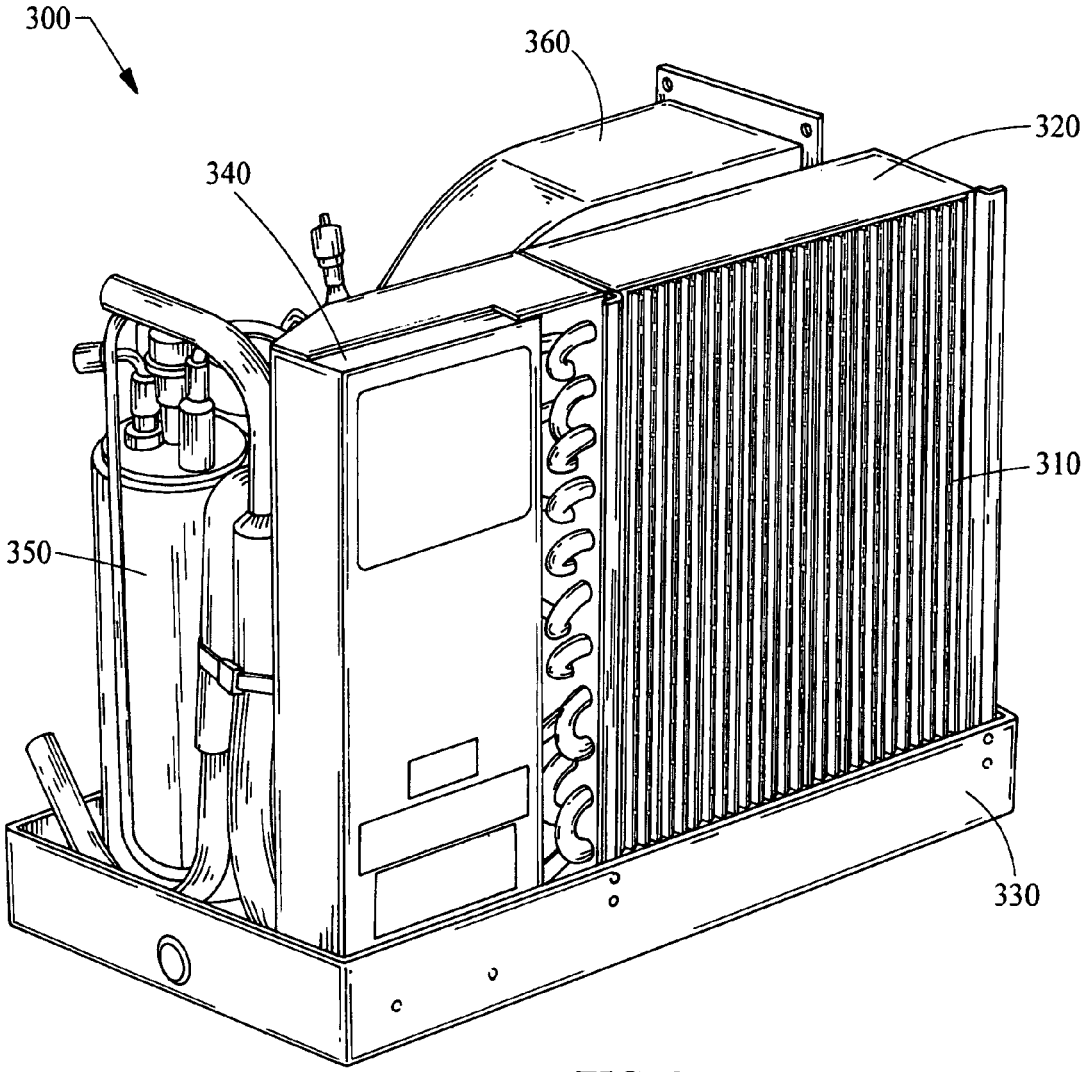
FIG. 3 is a plan view of a marine air conditioner.

Referring now to FIG. 3, there is shown a plan view of a marine air conditioner 300. For example purposes, the marine air conditioner 300 shown in FIG. 3 is a self contained unit. Self contained units are popular in recreational marine vehicles having a length of 18-50 feet because they are inexpensive, small, compact and are easy to install. A self contained unit may have a volume of approximately 1 cubic foot or other volume. A typical self contained unit may have a width of 8" or other dimension, a height of 11⅜" or other dimension, and a length of 16" or other dimension. The marine air conditioner 300 may include an evaporator coil 310, a shroud 320, a drain pan 330, a compressor 350, a condenser (not shown), power supply 340 and a blower 360.

The evaporator coil 310 may function as a heat exchanger. The transfer of heat from air to the evaporator coil 310 is related to the surface area of the evaporator coil 310. Heat may be transferred through the surface of the evaporator coil 310. Typically, an evaporator coil includes a series of refrigerant tubes integrated with fins. The evaporator coil 310 may be constructed of aluminum, copper or other material which readily transfers heat. The evaporator coil 310 may have dimensions of 8"×8"×2", 10"×12"×3", 8"×11"×4" or other dimensions.

The fins (not shown) of the evaporator coil 310 help maximize the surface area of the evaporator coil. Refrigerant may pass through the refrigerant tubes of the evaporator coil 310, expand and cool. Heat may be transferred from the air passing over the evaporator coil 310 through the surface of the evaporator coil 310 to the refrigerant. As heat is removed from the air passing over the evaporator coil 310, condensation may form on the surface of the evaporator coil 310.

The evaporator coil 310 may be disposed above the drain pan 330. The evaporator coil 310 may be mounted to, attached to or integral with the drain pan 330. The evaporator coil 310 may be at least partially enclosed by the shroud 320.

The condenser (not shown) may be disposed within the shroud 320 and behind the evaporator coil 310. The condenser may be disposed remote from the evaporator coil 310. The condenser may receive the heated refrigerant from the evaporator coil 310. The condenser may function as a heat exchanger wherein seawater is pumped through the condenser and heat is transferred from the refrigerant through the condenser and to the seawater. The heated seawater may then be returned to a body of water such as a sea, ocean, harbor, marina, lake or other body of water. The condenser may be mounted to, attached to or integral with the drain pan 330 and/or the shroud 320.

The blower 360 may include an enclosure (not shown) and a fan (not shown). The enclosure may be attached to, mounted to or integral with the drain pan 330 and/or the shroud 320. The blower 360 may receive air after it passes over the evaporator coil 310 and/or the condenser (not shown) and force the air into a duct (not shown) or into a cabin (not shown).

A shroud is a surface that covers, screens or guards a device. The shroud 320 may partially enclose and/or protect the evaporator coil 310 and/or the condenser (not shown). The shroud 320 may be attached to the evaporator coil 310 and/or to the drain pan 330. The shroud 320 may be manufactured from a metal, composite or other material. The shroud 320 may be rigid. The shroud 320 may function as a duct for the air to pass through from the evaporator coil 310 to the condenser (not shown) to the blower 360.

The shroud 320 may have a geometry based on the geometry of the evaporator coil 310, the condenser (not shown) and the blower 360. The geometry of the shroud 320 may include rectangular or other shaped sections (not shown) that surround the upper surface (not shown) and the side surfaces (not shown) of the evaporator coil 310. The geometry of the shroud 320 may include a tapered section enclosing the condenser (not shown) between the rectangular sections (not shown) and the blower 360. The geometry of the shroud 320 between the evaporator coil 320 and the blower 360 may include regular shapes, irregular shapes, steps, tapers and/or other geometries.

The compressor 350 is a motor which compresses a fluid. Typically, a compressor of an air conditioner will compress a refrigerant after it exits the condenser and before it enters the evaporator coil. The compressor 350 may be mounted, attached to or integral with the drain pan 330. The compressor 350 may be located remote from the evaporator coil 310.

A power supply is an electronic device or system that converts electric power from a form being received to a form which is supplied to a load. A power supply may include an enclosure and electronics housed within the enclosure. A power supply may convert power from DC to AC, from DC to DC, or from AC to DC, or other. A power supply may regulate electric power. The enclosure may protect the power supply. The power supply 340 may be attached to, mounted to or integral with the drain pan 330. The power supply 340 may receive power from a generator (not shown), an alternator (not shown) attached to the engine (not shown) of the marine vehicle (not shown), a dock power source or another power source. The power supply 340 may provide power to the compressor 350 and the blower 360.

The term drain pan refers to an open receptacle into which water may collect and be drained from. The drain pan 330 may provide a structural base to the compressor 350, the power supply 340, the evaporator coil 310, the shroud 320 and the blower 360. The drain pan 330 may be constructed of metal, composite or other material. The drain pan 330 may be disposed below the evaporator coil 310, the shroud 320 and the power supply 340. The drain pan 330 may be deep, for example 2" or other dimension. The drain pan 330 may have dimensions based on the dimensions of the marine air conditioner 300. For example, the drain pan may have a width of 8" or other dimension and a length of 16" or other dimension. The drain pan 330 may include one or more drain holes (not shown) connected to drain tubes (not shown). The drain pan 330 may receive condensation that drips down from the evaporator coil 310 and/or the condenser (not shown).

Due to factors such as condensation and humidity, some moisture may remain on the evaporator coil 310 and in the drain pan 330 for an extended duration. It is common for bacteria, viruses, molds, microbes and other microorganisms to grow on moist surfaces. When the evaporator coil 310 accumulates undesirable substances on its surface, it will not function at optimum efficiency because its effective surface area for heat transfer will be reduced. Undesirable substances refer to any of mold, bacteria, fungi, viruses, mildew, allergens, spores, yeasts, mycotoxins, and endotoxins.

Figure 4:
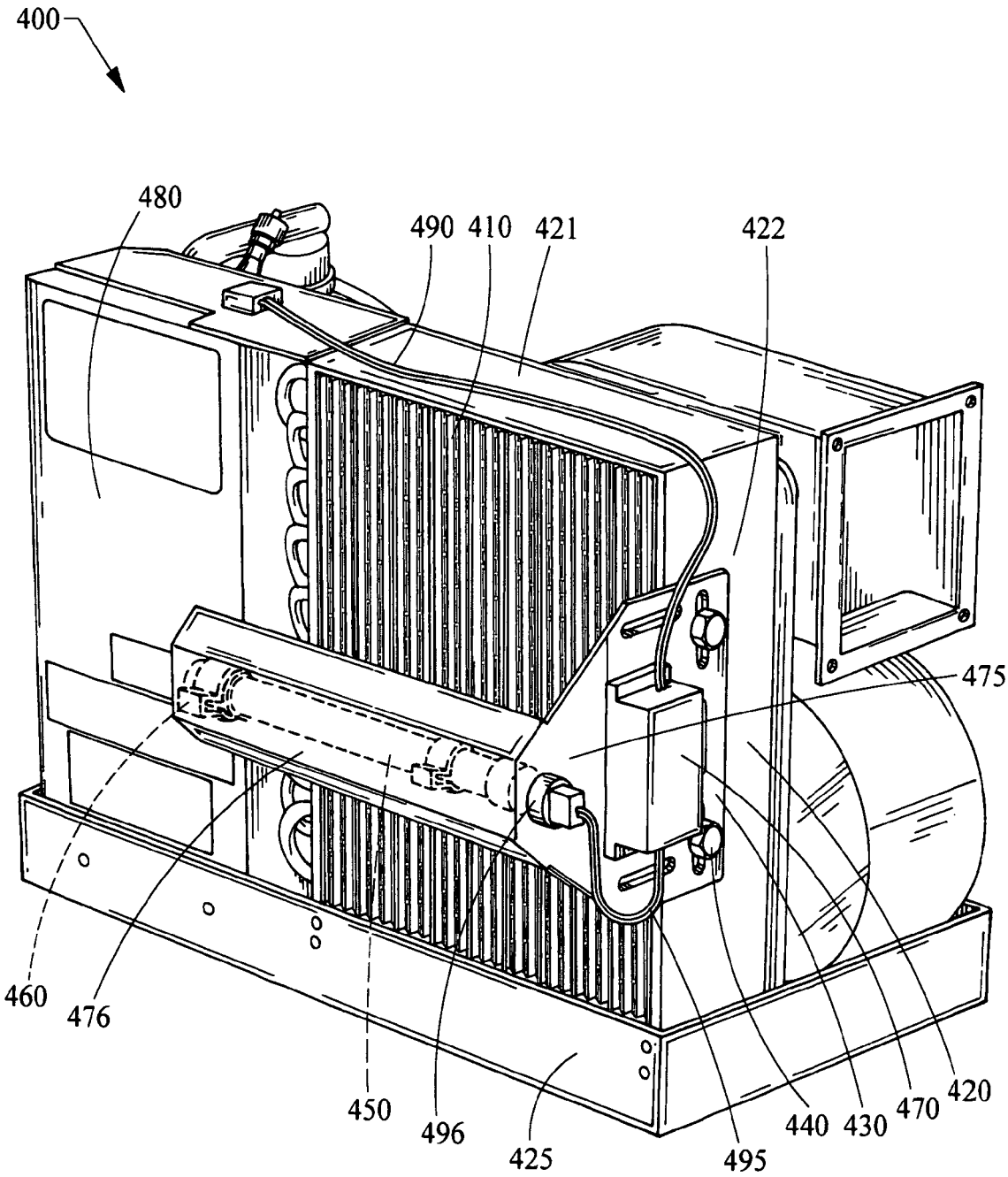
FIG. 4 is a plan view of a marine air conditioner.

Referring now to FIG. 4, there is shown a plan view of a marine air conditioning system 400. The marine air conditioner 400 may include an evaporator coil 410, a shroud 420, a first power supply 480, a drain pan 425, a bracket 430, an electric discharge lamp 450, a clasp 460, a second power supply 470 and wires 490.

The term electric discharge lamp refers to an apparatus which emits radiation caused by an electric discharge from electrodes in an enclosure. An electric discharge is electrical conduction through a gas or vapor in an applied electric field. An enclosure is a hollow device used to hold vaporizable materials and gases. An enclosure may be at least partially translucent. An enclosure may be constructed of glass, metal, quartz, or plastic. Electric discharge lamps may be fluorescent lamps, mercury vapor lamps, low pressure sodium lamps and high pressure sodium lamps.

The electric discharge lamp 450 may be shaped toroidal, u-shaped, cylindrical, bulbous or other shape. The electric discharge lamp 450 may have a cross sectional shape of a circle, an oval, a tetrahedron, a pentagon, a hexagon, an octagon or other shape. Common cylindrical electric discharge lamps are manufactured in lengths of approximately 16", 22", 28", 34", 40" and other lengths. The dimensions of the electric discharge lamp 450 may be based on the dimensions of the evaporator coil 450.

The electric discharge lamp 450 may include a vaporizable material, such as mercury. The mercury, when electrically excited, may emit ultraviolet light at a germicidal wavelength. A germicidal wavelength may be at an ultraviolet-C (UVC) wavelength. A germicidal wavelength, for example 254 nm, is a wavelength of light which retards buildup or accumulation of undesirable substances. UVC may also kill undesirable substances.

The term germicidal lamp refers to a device which emits light at a germicidal wavelength. Examples of germicidal lamps include electric discharge lamps and solid state devices. Solid state devices include light emitting diodes. Some deep ultraviolet light emitting diodes may emit light at a wavelength between 250 nm and 290 nm with a peak of 254 nm or other wavelengths. Deep ultraviolet light emitting diodes may be disposed in an array, for example a 4×4 array, a 10×10 array or other configuration.

A bracket is a structural device which mounts one device in a fixed position relative to another surface. Typically, a bracket may support a vertical load, have two sections that are disposed at an angle to one another. A bracket may serve as a brace, a cantilever, or a support for a shelf or other surface or device. The bracket 430 may include a first section 475 and a second section 476. The first section 475 may be attached to, mounted to or integral with the shroud 420. If the bracket 430 is integral with the shroud 420, the bracket may be referred to as a flange. The first section 475 may be attached to a vertical surface 422 of the shroud 420 or a horizontal surface 421 of the shroud 420. The bracket 430 may receive mechanical support from the shroud 420.

The marine air conditioner system 400 may include a dampener (not shown) abutting both the first section 475 of the bracket 430 and the shroud 420. The dampener may vibration and/or shock from effecting the electric discharge lamp 450. The dampener may be a dampening sheet, a cushion pad, a bushing, a grommet, a washer, a spring, a shock, a bumper, a foam tape, a gasket, a dampening tape or other dampener. Vibration and/or shock have a tendency to cause the electric discharge lamp 450 to prematurely fail. By reducing the amount of vibration and shock transmitted to the electric discharge lamp 450, the life of the electric discharge lamp 450 may be preserved. Thus, maintenance costs associated with replacing the electric discharge lamp 450 may be reduced.

The first section 475 may be attached to the shroud 420 via a fastener 440, a clamp (not shown), a brazing (not shown), an adhesive (not shown) or a magnet (not shown). When the first section 475 is attached to the shroud, the first section 475 may be disposed in the same plane or parallel to a surface of the shroud 420 to which the first section 475 is attached. The first section 475 may have dimensions of an 11" height, an 8" depth and a 1/32" thickness or other dimensions.

The height of the first section 475 may be based on the dimensions of vertical surface 422 of the shroud 420. For example, the height of the first section 475 may be approximately ½ of the height of the vertical surface 422 of the shroud or other ratio. The height of the first section 475 may be based on the dimensions of another surface to which the first section 475 is attached, for example the power supply 480 or the drain pan 425.

The depth of the first section 475 may be based on the distance between the return air grille (not shown) and the marine air conditioner 400, the depth of the vertical surface 422 of the shroud 420 or another surface to which the first section 475 is attached. For example, if the distance between the return air grille (not shown) and the marine air conditioner is 20", the depth of the first section 475 may be 12.8" or other dimension.

The first section 475 may have dimensions of a square, rectangle, rhombus, trapezoid or other shape. The first section 475 may have a geometry based on the dimensions of the second power supply 470 in order to provide mechanical support to the second power supply 470. The bracket 430 may comprise a rigid material, for example a metal or a composite. The bracket 430 may comprise a material reflective of UVC, for example aluminum, steel or another material.

The second section 476 may be disposed at a 90° or other angle to the first section 475. When the first section 475 is attached to the shroud 420, the second section 476 may be offset relative to the evaporator coil 410. The second section 476 may be parallel to the length of the evaporator coil 410. The second section 476 may be substantially flat, curved, or bent in multiple sections along the length of the second section 476. The second section 476 may include a concave surface (not shown) facing the evaporator coil 410. A bent, curved or concave surface may allow radiation to be reflected from the electric discharge lamp 450 to the surface of the evaporator coil 410. The first section 475 and/or the second section 476 may provide mechanical support to the electric discharge lamp 450. The second section 476 may have dimensions of 11"×4"×1/32" or other dimensions. The second section 476 may have a height based on the diameter of the electric discharge lamp 450. For example, the height of the second section 476 may be two or three times the diameter of the electric discharge lamp 450 or other ratio. If the second section 476 has height of two or three times the diameter of the electric discharge lamp 450, the second section 476 may reflect UVC radiation from the electric discharge lamp 450 towards the evaporator coil 410. The height of the second section 476 may be sufficiently small so that air flow is not greatly obstructed to the evaporator coil 410.

The bracket 430 may fix the electric discharge lamp 450 relative to the evaporator coil 410. The electric discharge lamp 450 may be secured relative to the second section 476 of bracket 430 via a clasp 460. The electric discharge lamp 450 may be secured relative to the first section 475 of the bracket 430 via a recessed mount (not shown). The electric discharge lamp 450 may be disposed substantially parallel to the length of the evaporator coil 410. The electric discharge lamp 450 may be disposed at an angle relative to the evaporator coil 410. The electric discharge lamp 450 may be disposed substantially perpendicular to the length of the evaporator coil 410. If the electric discharge lamp 450 is disposed substantially perpendicular to the length of the evaporator coil 410, the UVC radiation emitted from the electric discharge lamp 450 may reflect off the fins (not shown) and strike all or the majority of the surfaces of the evaporator coil 410. The electric discharge lamp 450 may be offset from the evaporator coil 410 by 3", 8", 12.8" or other dimension. The electric discharge lamp 450 may be offset from the evaporator coil 410 by a distance approximately 80% of the length of the electric discharge lamp 450. The electric discharge lamp 450 may be offset from the evaporator coil 410 by a distance approximately 25%-75% of the height of the evaporator coil 410. For example, if the height of the evaporator coil 410 is 12", the electric discharge lamp 450 may be offset from the evaporator coil 410 by 3", 6", 9" or other dimension. By offsetting the electric discharge lamp 450 from the evaporator coil 410 by a distance approximately 25%-75% of the height of the evaporator coil 410, uniform distribution of UVC may be emitted towards the evaporator coil 410.

The clasp 460 may provide mechanical support to the electric discharge lamp 450. The clasp 460 may affix to the bracket 430 via a fastener, a welding, a magnet, or an adhesive. The clasp 460 may be integral to the bracket 430. The clasp 460 may be one of or combinations of a spring clamp, a clamp, a sleeve, a hanger, a race, a locking clamp, a clip, a holster, and a strap. The clasp 460 may include subassemblies comprising a metal, plastic, composite or other material. The clasp 460 may include fasteners. The clasp 460 may at least partially surround a circumference of the electric discharge lamp 450. The clasp 460 may comprise a material that is resistant to heat and environmental elements. An example of the clasp 460 is a stamped aluminum spring clip with a hard plastic coating. The clasp 460 may secure the electric discharge lamp 450 in relation to the bracket 430. The marine air conditioning system 400 may include a dampener (not shown) abutting both the electric discharge lamp 450 and the clasp 460. The dampener (not shown) may reduce vibration and shock from effecting the electric discharge lamp 450.

The second power supply 470 may provide power to the electric discharge lamp 450 via wires 495 and a socket 496. The second power supply 470 may be electrically connected to the first power supply 480 or another power source via plural wires 490. The second power supply 470 may be mounted or attached to the bracket 470. The second power supply 470 may be located remote from the bracket 470. The second power supply 470 may be or include a ballast. A ballast is a power converter that regulates electric power and functions as a starting and control unit for an electric discharge device. The ballast initially provides a voltage to ionize the gas or vaporizable material in the tube. The ballast then controls the power that drives the electric discharge lamp 450. The second power supply 470 may be integral to the electric discharge lamp 450.

When the marine air conditioning system 400 is installed and operating, the electric discharge lamp 450 may emit UVC radiation towards the evaporator coil 410 and/or to a drain pan 425. The electric discharge lamp 450 may emit UVC omnidirectionally. The electric discharge lamp 450 may emit UVC directly towards the second section 476 of the bracket 470, which in turn may reflect the UVC towards the evaporator coil 410. The electric discharge lamp 450 may emit UVC at a wavelength substantially at 253.7 nm towards a surface of the evaporator coil 410 and/or the drain pan 425 while generating an insignificant quantity or less of ozone. The electric discharge lamp 450 may be disposed upstream of the evaporator coil 410 such that the minimum photon energy striking the surface of the evaporator coil 410 is at least 430 $\mu W/cm^2$.

By emitting UVC towards the evaporator coil 410, undesirable substances may be reduced from the surface of the evaporator coil 410, maximizing the surface area of the evaporator coil 410. Because efficiency of the marine air conditioning system 400 is related to the surface area of the evaporator coil 410, the UVC radiation may cause the marine air conditioning system 400 to consume less energy.

Typically, maintenance of evaporator coils require chemical cleaning when undesirable substances build up on the evaporator coils. If undesirable substances are reduced from the surface of the evaporator coil 410 via UVC radiation, the evaporator coil 410 may not require chemical cleaning as frequently. Thus, maintenance costs may be reduced. Moreover, the electric discharge lamp 450 may at least partially sterilize the air provided to the cabin. If the electric discharge lamp 450 at least partially sterilizes the air provided by the marine air conditioning system 400, the indoor air quality (IAQ) of the cabin may be improved.

Figure 5:
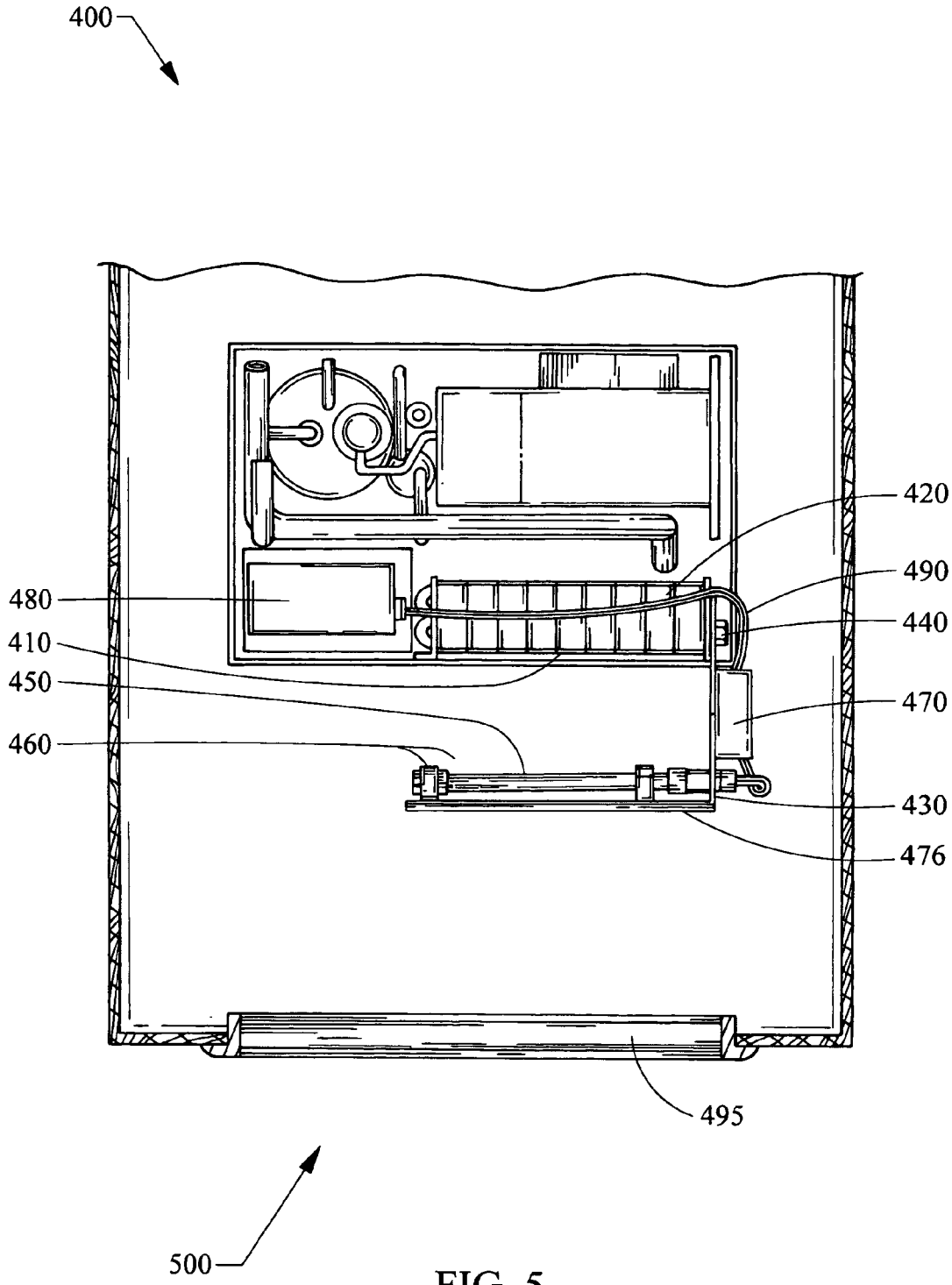
FIG. 5 is a plan view of a marine air conditioner.

Referring now to FIG. 5, there is shown an elevated view of the marine air conditioning system of FIG. 4. The electric discharge lamp 450 may be disposed upstream of evaporator coil 410. The electric discharge lamp 150 may be disposed between the return air grille 495 and the evaporator coil 410. By reflecting UVC back to the evaporator coil 410, the second section 476 of the bracket 430 may prevent UVC from being emitted from the electric discharge lamp 450 through the return air grille 495 into the cabin 500.

Figure 6:
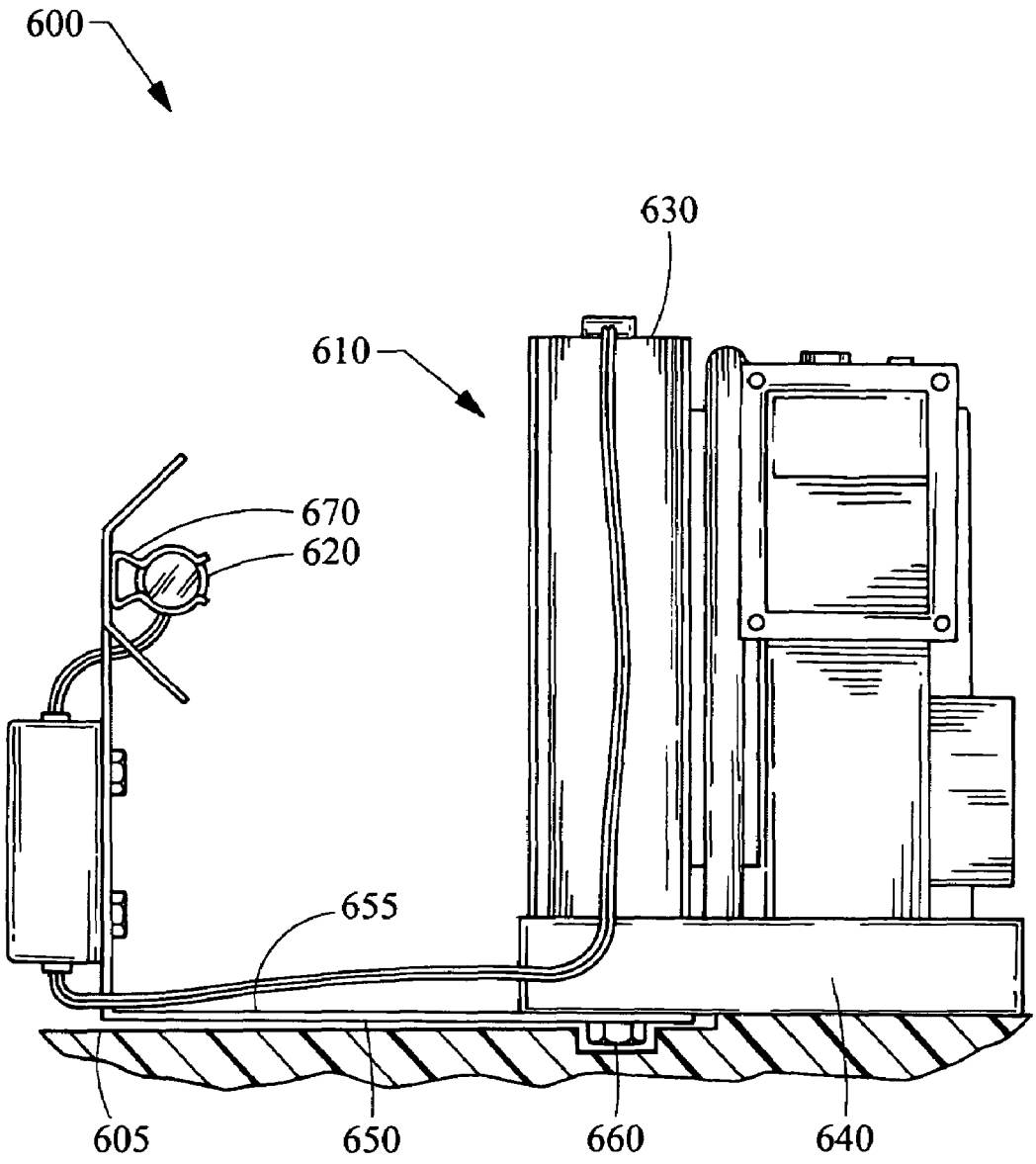
FIG. 6 is a perspective view of a marine air conditioner.

Referring now to FIG. 6, there is shown a perspective view of a marine air conditioning system 600. The marine air conditioning system 600 may include an evaporator coil 610, a shroud 630, a drain pan 640, a bracket 650 a clasp 670 and an electric discharge lamp 620. The bracket 650 may be attached to, mounted to or integral with the drain pan 640. If the bracket 650 is integral with the drain pan 640, the bracket 650 may be referred to as a flange. The bracket 650 may be attached to the drain pan 640 via a fastener 660, an adhesive (not shown), a brazing (not shown), a welding (not shown), a magnet (not shown) or other means. The bracket 650 may extend at least partially or the entire length and width of the drain pan 640. The bracket 650 may be secured in place relative to the floor 605 solely by the marine air conditioner resting on the first section 655 of the bracket 650. The bracket 650 may provide mechanical support to the electric discharge lamp 620.

Figure 7:
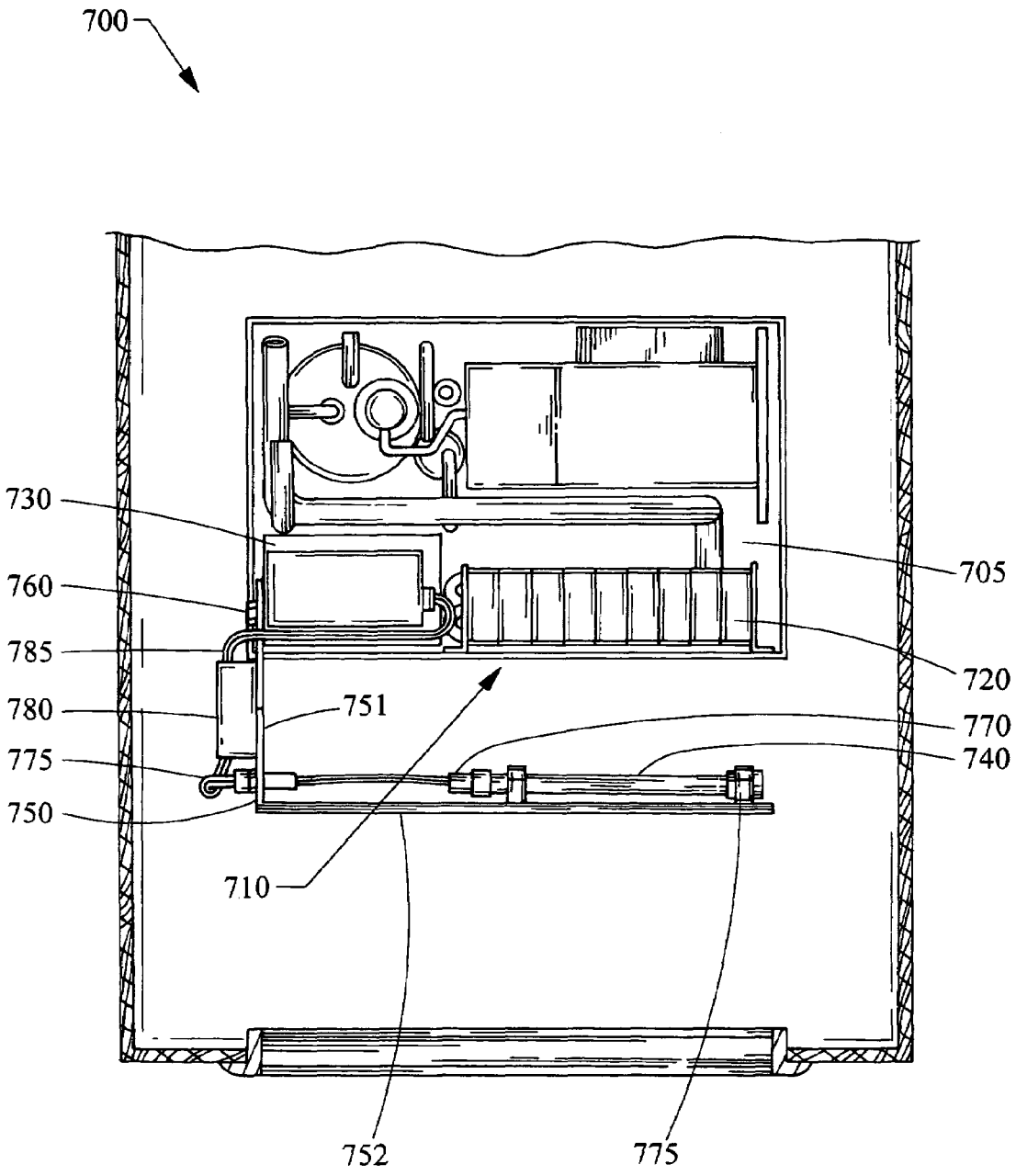
FIG. 7 is a plan view of a marine air conditioner.

Referring now to FIG. 7, there is shown a plan view of a marine air conditioning system 700. The marine air conditioning system 700 may include an evaporator coil 710, a shroud 720, a drain pan 705, a first power supply 730, a bracket 750, an electric discharge lamp 740 and a second power supply 780. The drain pan 705 may be disposed below the evaporator coil 710 and the first power supply 730. The bracket 750 may include a first section 751 and a second section 752. The first section 751 may be attached to, mounted to or integral with the first power supply 730. If the bracket 750 is integral with the first power supply 730, the bracket 750 may be referred to as a flange. The first section 751 may be attached to the first power supply 730 with a fastener 760, a brazing (not shown), an adhesive, a magnet or other means. The bracket 750 may provide mechanical support to the electric discharge lamp 740 via a clasp 775. The electric discharge lamp 740 may receive electric power from the socket 770. The socket 770 may be electrically connected to the second power supply 780 via electric wires 775. The second power supply 780 may be electrically connected to the first power supply 730 via electric wires 785.

Figure 8:
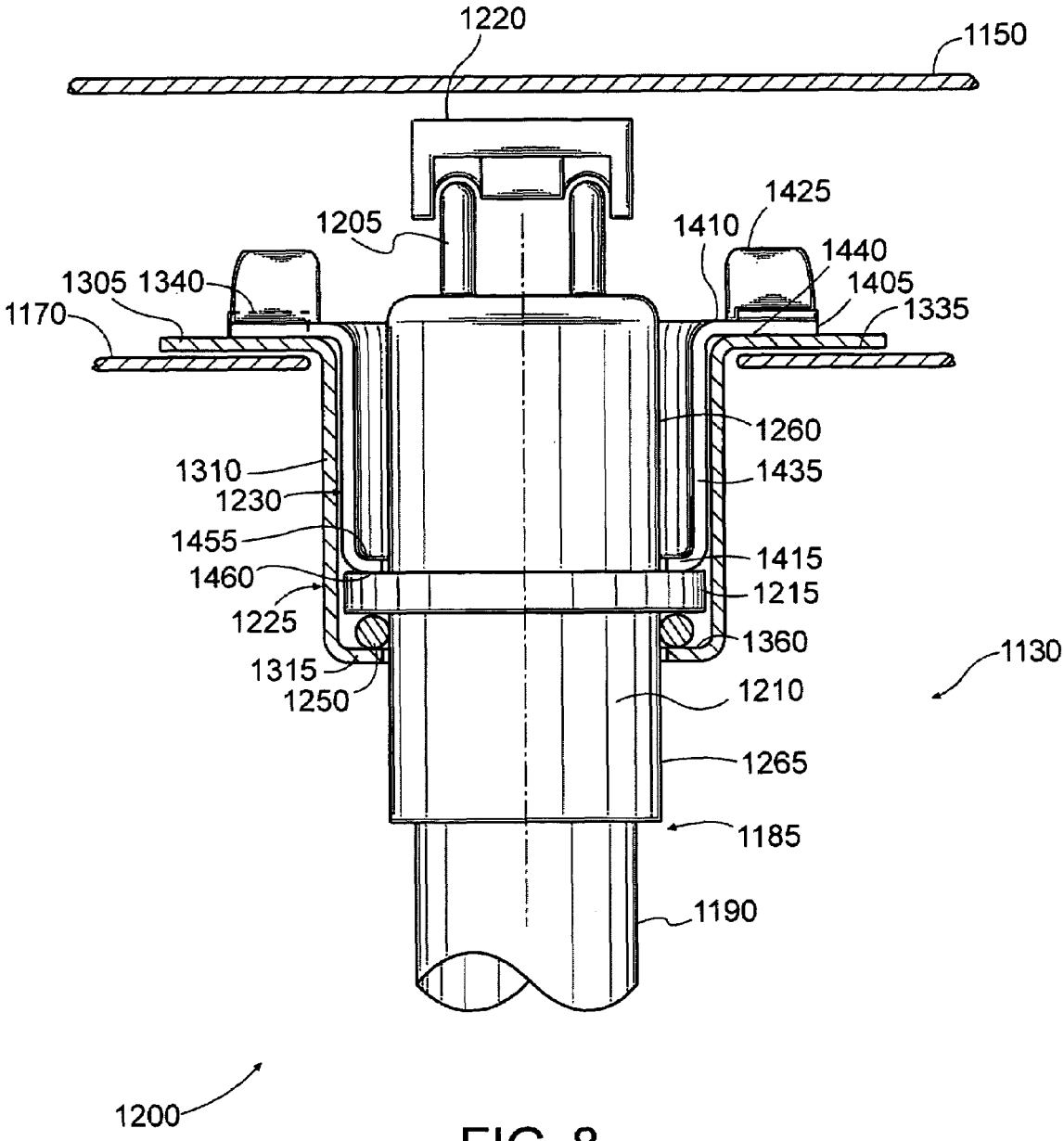
FIG. 8 is a cut-away perspective view of a mounting system.

Referring now to FIG. 8, there is shown a cut-away perspective view of a recessed mounting system 1200. The recessed mounting system 1200 includes a cradle 1225, a retainer 1230, an electric discharge lamp 1185, and a wall 1170.

The electric discharge lamp 1185 may include an electrical contact 1205 and a stem 1210. The stem 1210 may include a rim 1215, a first section 1260, and a second section 1265. The second section 1265 of the stem 1210 may attach to an end of the tube 1190. The stem 1210 may have the geometry of a cylinder or other shape. For example, the dimensions of the stem 1210 may include a diameter of approximately 0.75", and a length of 1.25" or other dimensions.

A rim is a projecting edge or border. The rim 1215 may be a mounting surface for the electric discharge lamp 1185. The electric discharge lamp 1185 may receive mechanical support at the rim. For example, the rim 1215 may be secured by the mount 1180. The rim 1215 may be integral to the first section 1260 and the second section 1265. The rim 1215 may extend radially, approximately ⅛" or other dimension, from a circumference of the stem 1215. The rim 1215 may have a diameter of approximately 1" or other dimension. The rim 1215 may be coated with a ferrous or magnetic material. A magnet (not shown) may be attached to the rim 1215 with an adhesive such as glue or double sided tape.

The electrical contact 1205 may receive power from a socket 1220. The electrical contact 1205 may be attached to and/or embedded within the first section 1260 of the stem 1215. The electrical contact 1205 may have an industry standard form such as a bi-pin, a single pin, a R17d, a medium bi-pin, a four pin, a 2Gx13, a recessed double contact, a G-23, or a 2G-11.

The socket 1220 may be electrically connected to a power supply (not shown) via wiring (not shown). The power supply (not shown) may provide power to the electric discharge lamp 1185 via the wiring, (not shown), and the socket 1220. When electric power is provided to the electric contact 1205, the electric discharge lamp 1185 may emit radiation.

Figure 9:
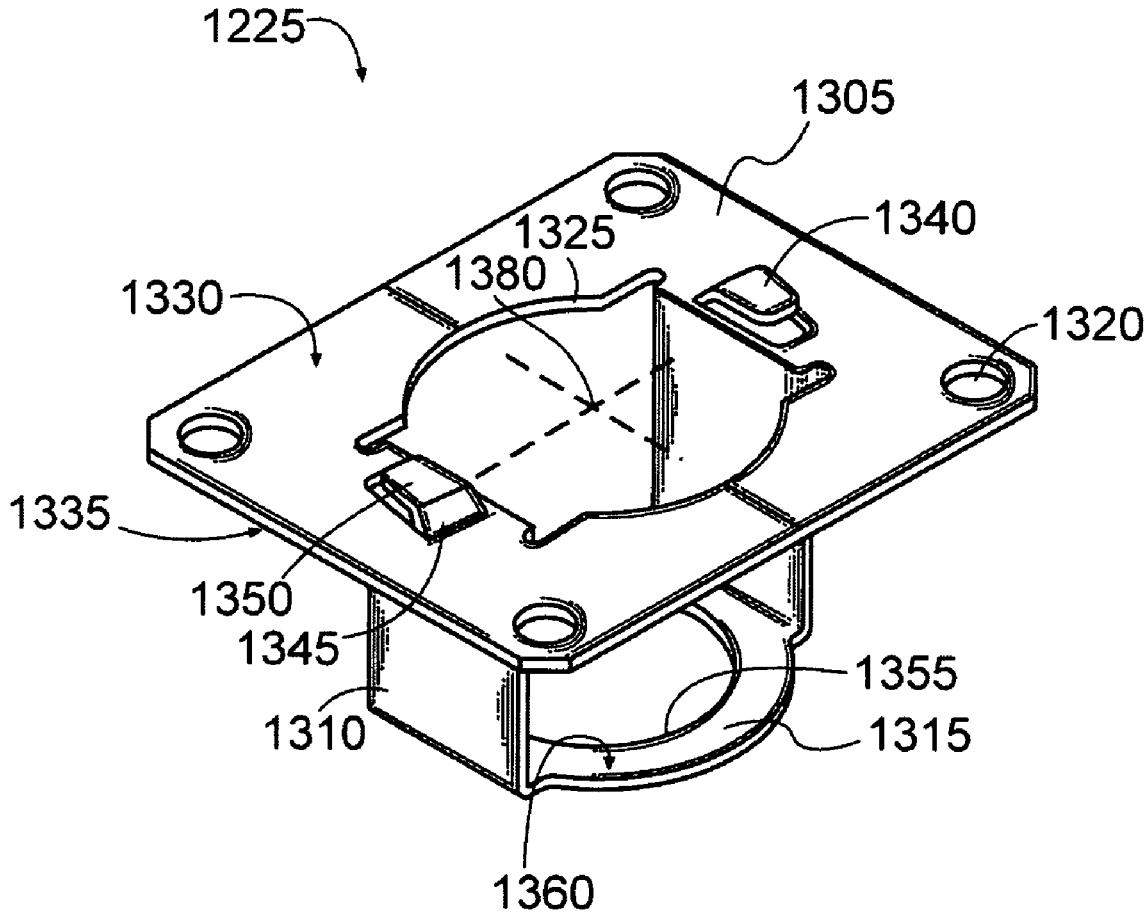
FIG. 9 is a plan view of a cradle.

The cradle 1225, also shown in the plan view of FIG. 9, may include a flange 1305, a cantilever 1310, and a base 1315. The cradle 1225 may attach to the wall 1170, bracket (not shown), or other surface (not shown). The cradle 1225 may provide mechanical support to the electric discharge lamp 1185.

The cradle 1225 may be machined and/or formed from a metal, injection molded with a plastic, or manufactured via another process. The cradle 1225 may be constructed of a single piece of material. For example purposes, the cradle 1225 may be manufactured from galvanized steel, polypropylene, carbon fiber, or other material. The cradle 1225 may be coated with a urethane or other material. The coating (not shown) may protect the cradle 1225 from corroding and insulate the cradle 1225 from electric current.

Figure 11:
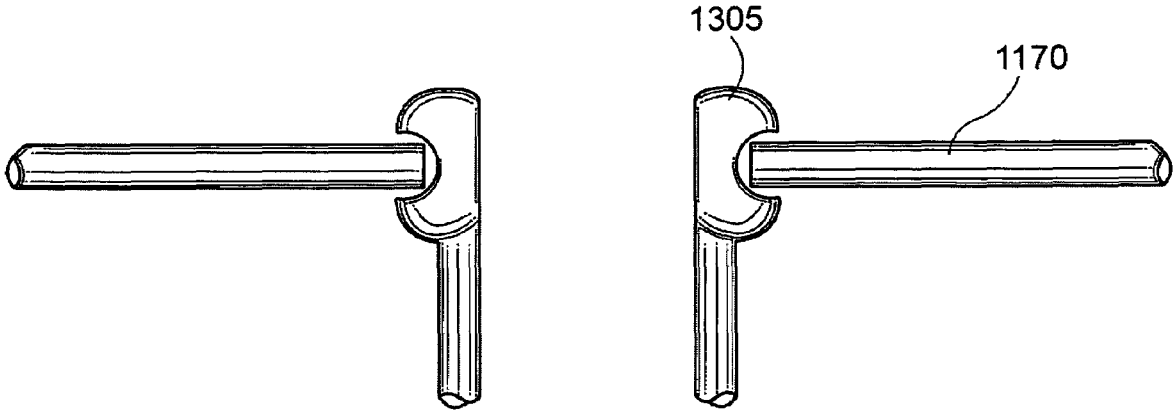
FIG. 11 is a partial cut-away perspective view of a cradle.
Figure 12:
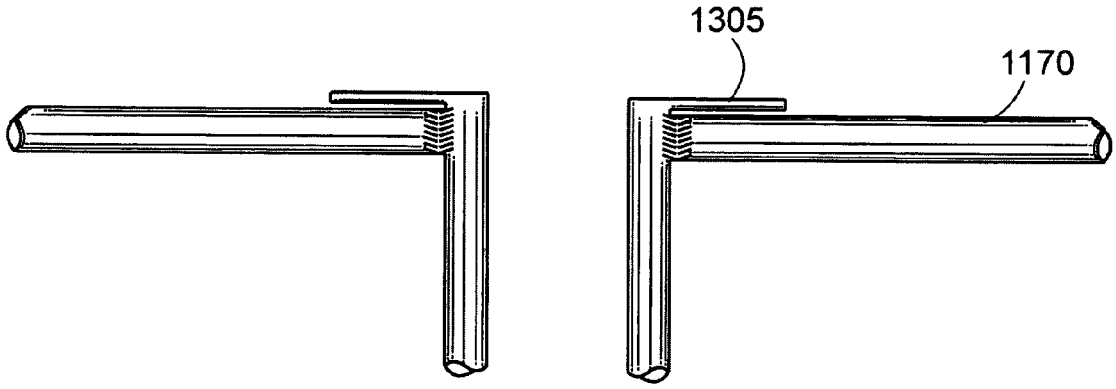
FIG. 12 is a partial cut-away perspective view of a cradle.

The flange 1305 may include a first opening 1320, a second opening 1325, a top surface 1330, a bottom surface 1335, and an ear 1340. A flange is a surface for attaching one body to another. The cradle 1225 may be attached to the wall 1170 via the flange 1305. The flange 1305 may be attached to the wall via a fastener, an adhesive, a magnet, or a welding. The flange 1305 may be formed as a sleeve or channel, as shown in the partial cut-away perspective view of FIG. 11, which forms a friction fit or a snap fit between the flange 1305 and the wall. The flange 1305 may include threaded edges to screw into the wall 1170, as shown in the partial cut-away perspective view of FIG. 12.

Referring again to FIG. 8, the flange 1305 may have the geometry of a rectangle, square, circle, or other shape. For example purposes, the flange 1305 may have dimensions of 1.4" in width, 1.7" in length, and 0.03" in thickness. The flange 1305 may have rounded corners and beveled edges. Rounded corners and beveled edges may prevent installers from cutting their fingers during installation.

The first opening 1320 may be a hole for a fastener (not shown) to pass through. The first opening 1320 may be have a circular, square, or other shape. For example purposes, the first opening 1320 may be a circular hole with a ⅛" diameter. Moreover, the flange 1305 may include a plurality of second openings 1325. The first opening 1320 may be located near an edge of the flange 1305 to provide for mounting stability. For example, the first opening 1320 may be located at approximately 0.17" from an edge of the flange 1305. The flange 1305 may include a first opening 1320 or a plurality of second openings 1325.

When the flange 1325 is attached to the wall 1170, the bottom surface 1335 may contact the wall 1170. A gasket (not shown) may be disposed between the bottom surface 1335 and the wall 1170. The gasket may provide for a more secure fit, may prevent scratches between the bottom surface 1335 and the wall 1170, the gasket may reduce vibrations and/or shock from being transmitted to the electric discharge lamp 1185.

Vibration refers to a periodic motion of a mass in alternately opposite directions from the position of equilibrium when that equilibrium has been disturbed, for example by a sinusoidal force. Vibration may occur when a compressor and/or a fan of an air handler is running. Shock refers to an impact as in a striking, an impinging, or a collision. Shock may occur when a person bumps into an air handler. Vibration and/or shock, if transmitted to the electric discharge lamp 1185, may cause the tube 1190 to prematurely fracture and/or fail. Installation of a gasket may reduce the frequency of replacement of the electric discharge lamp 1185.

The second opening 1325 may allow the electric discharge lamp 1185 to pass through for installation. The second opening 1325 may have a geometry that is circular, irregular or other shape. The dimensions of the second opening 1325 may be selected to be larger in diameter than the circumferences of the tube 1190, the stem 1210, and the rim 1215. For example, the second opening 1325 may have a diameter of 1", or other dimension. The second opening 1325 may be located near the center 1380 of the flange 1305. The second opening 1325 may be offset from the center 1380 of the flange 1305.

The ear 1340 may be a small tab which projects above the top surface 1330 of the flange 1305 to facilitate grasping of the retainer 1230. The ear 1340 may be bent in order to function as a catch. A catch is a device which clasps or seizes another device. The ear 1340 may include a first section 1345 integral to the flange 1305. For example purposes, the ear 1340 may be offset above the top surface 1330 by approximately 0.04" or other dimension. The first section 1345 may be disposed at an angle above the flange 1305. The ear may include a second section 1350. The second section may be integral to the first section 1345. The second section 1350 may be parallel to the top surface 1330 of the flange 1305. The second section 1350 may be disposed at an angle of approximately 5 degrees or other angle relative to the top surface 1330 of the flange 1305. If the second section 1350 tips up relative to the top surface 1330 of the flange 1305, the retainer 1230 may engage the flange 1225 more securely.

The ear 1340 may include ribs (not shown) or clips (not shown). The ear 1340 may include a magnetic coating. A magnet (not shown) may be attached to the ear 1340. A rib, a clip, or a magnet may individually, or in combination, assist in securing the retainer 1230 to the flange 1305.

The cantilever 1310 may offset the base 1315 away from and in the direction the bottom surface 1335 of the flange 1305 faces. When the flange 1305 is attached to the wall 1170, the base 1315 may be recessed beyond the wall 1170. A cantilever is a projecting member supported at only one end. The cantilever 1310 may be integral with the flange 1305 at the second opening 1325 of the flange 1305 or at another section of the flange 1305. The cantilever 1310 may have a cylindrical, a rectangular, or other geometry. The cradle 1225 may include a cantilever 1310 or a plurality of cantilevers 1310. For example purposes, FIG. 9 shows two cantilevers 1310.

The base 1315 may be a mounting surface for securing the rim 1215 of the electric discharge lamp 1185. The base 1315 may be supported by the cantilever 1310. The base 1315 may be integral with the cantilever 1310. The base 1315 may have the geometry of a circle, a rectangle, or other regular or irregular shape. For example purposes, the base 1315 of FIG. 9 has a circular geometry with a diameter of approximately 1.12".

The base 1315 may include an opening 1355 and a top surface 1360. The opening 1355 may be circular or other geometry. The dimensions of the opening 1355 may be selected to be larger than a circumference of the tube 1190 of the electric discharge lamp 1185, the second section 1265 of the electric discharge lamp 1185, but not the rim 1215 of the electric discharge lamp 1185. For example, the opening 1355 may have a diameter of approximately 0.8". The tube 1185 and the second section 1265 of the electric discharge lamp 1185 may pass through the opening 1355 for installation.

The base 1315 may include a ferrous coating. A magnet (not shown) may be attached to the base 1315. A hook and loop fastener may be attached to the base 1315 and the rim 1215. A reusable or permanent adhesive may be applied to the base 1315 and the rim 1215. The rim 1215 may be at least partially secured to the base 1315 by one of or combinations of the magnet, the hook and loop fastener, and the adhesive.

The base 1315 may be parallel to the flange 1305. The base 1315 may be normal to the cantilever 1310. The term normal refers to perpendicular.

As shown in FIG. 8, when the electric discharge lamp 1185 is installed in the mount 1180, the rim 1215 may be in contact with the top surface 1360 of the base 1315. A gasket 1250 may be disposed between the rim 1215 and the top surface 1360 of the base 1315. The gasket 1250 may be an o-ring. The gasket may be constructed of a butyl rubber, a siliceous ring, or other material. The gasket 1250 may provide for a more secure mounting of the electric discharge lamp 1185. The gasket 1250 may reduce the transmission of vibration and/or shock to the electric discharge lamp 1185.

Figure 10:
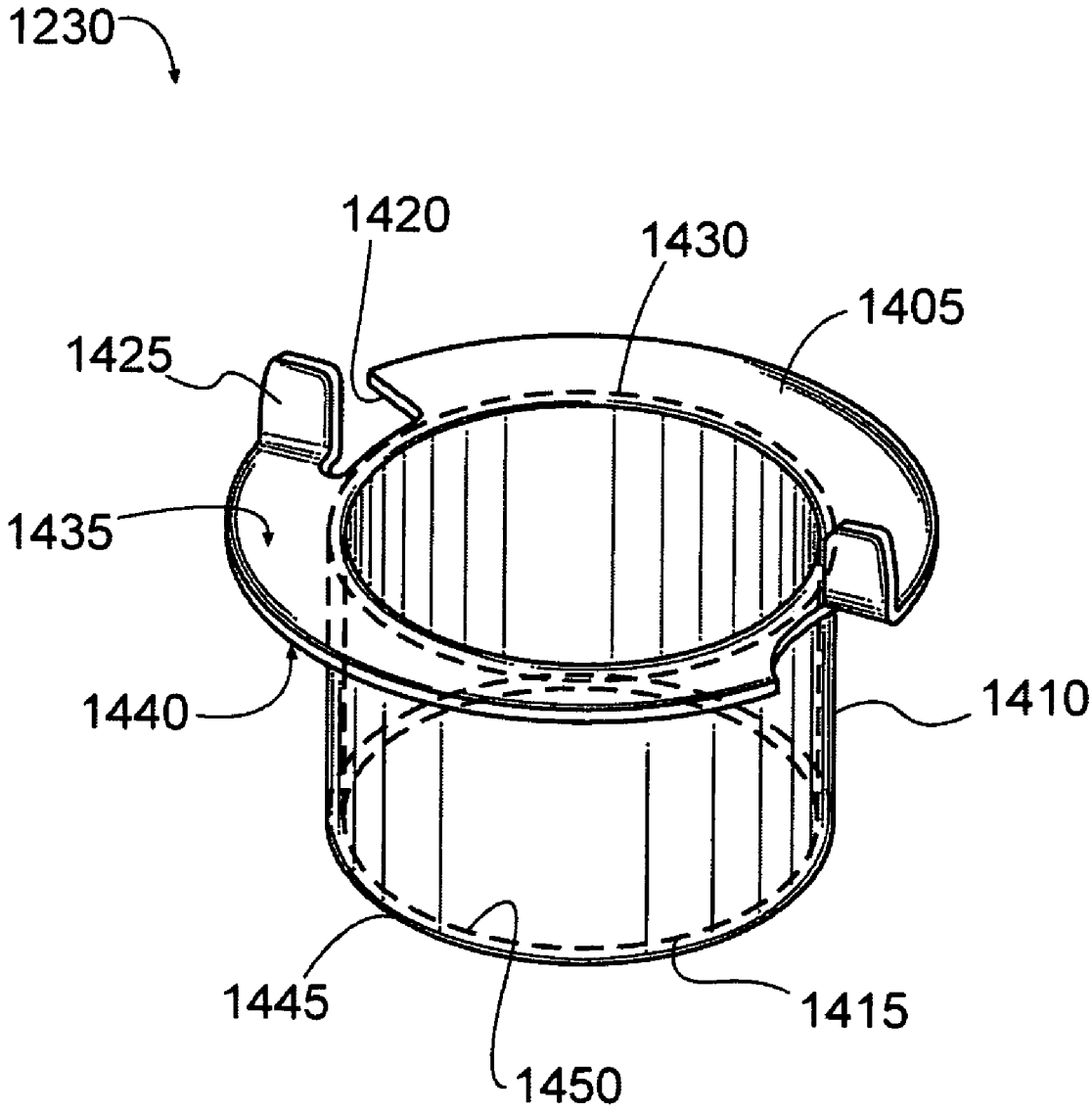
FIG. 10 is a plan view of a retainer.

The retainer 1230, also shown in the plan view of FIG. 10, may engage the cradle 1225 and secure the rim 1215 to the base 1315. A retainer is a device to hold another device in place. The retainer 230 may include a collar 1405, a shaft 1410, and a ring 1415. The retainer 1230 may be machined, molded, extruded or constructed via another process. The retainer 1230 may include a coating (not shown) to protect from corrosion and insulate from electric current. For example purposes, the retainer 1230 may be manufactured from galvanized steel, polypropylene, or carbon fiber.

The retainer 1230 may engage the cradle 1225 as a bayonet mount. The collar 1405 may engage the flange 1305 causing the retainer 1230 to mate to the cradle 1225. The collar 1405 may include a top surface 1410, a bottom surface 1440, an edge 1420, a tab 1425, and an opening 1430. The collar 1430 may have the geometry of a circle, or other shape. For example purposes, the collar may have a diameter of 1.4". The collar may include an opening 1430. The opening 1430 may have the geometry of a circle, or other shape. The dimensions of the opening 1430 may be selected to be larger than a circumference of the first section 1260 of the stem 1210. For example, the opening 1430 may have a diameter of approximately 1". During installation, the opening 1430 of the retainer 1230 may pass over the first section 1260 of the stem 1210.

The tab 1425 may be a handling member for an installer of the retainer 1230. The tab 1425 may be cut out from the collar 1405. The tab 1425 may be bent up from the collar 1405. The tab 1425 may be bent in the direction which the top surface 1410 faces or another direction. For example, the tab 1425 may have a length of approximately 0.3" and a width of approximately 0.25". The tab 1425 may allow an installer of the mount 1180 to rotate the retainer 1230 when the retainer 1230 is recessed within the cradle 1225.

The top surface 1410 of the collar 1405 may include a rough surface (not shown). The rough surface may provide sufficient friction for an installer to rotate the retainer 1230 with their fingertips. The top surface 1410 of the collar 1405 may include ridges (not shown). The ridges may provide a surface for the installer to rotate the retainer 1230. The collar 1405 may include a finger hole (not shown) or a series of finger holes. A finger hole is an opening through which the tip of a finger may fit. The finger hole may have a diameter of approximately 0.5". An installer may insert a finger into the finger hole to handle the retainer 1230. The rough surface, the ridges, or the finger hole may be used individually, in combination with, or in lieu of the tab 1425 to provide the installer with handling surfaces.

The edge 1420 may be a section of the collar 1405 from where the tab 1425 was cut out from. The edge 1420 may be bent slightly downward in the direction that the bottom surface 1440 faces. When the retainer 1230 is installed, the bottom surface 1440 of the collar 1405 may abut the top surface 1330 of the flange 1305. The retainer 1230 may be rotated such that the edge 1420 may slide under at least part of the ear 1340. The edge 1420 may engage the ear 1340 via a friction fit. The edge 1420 may engage the ear 1340 via a latch, clasp, magnet, or other.

The shaft 1435 may offset the ring 1415 in the direction that the bottom surface 1440 of the collar 1405 faces. A shaft is an elongate hollow member, typically having the geometry of a cylinder. The shaft 1435 may be integral with the collar 1405. The shaft 1435 may have the geometry of hollow cylinder or other geometry. In lieu of an elongate hollow member, the shaft 1435 may be a cantilever or a plurality of cantilevers. The shaft 1435 may be perpendicular to the collar 1405. The dimensions of the shaft 1435 may be selected to be larger than the first section 1260 of the stem 1210. For example purposes, the shaft may have a diameter of approximately 1" and a length of approximately 0.9". By offsetting the ring 1415, when the retainer 1230 is installed, the ring 1415 may be recessed beyond the wall 1170.

A ring is a circular or curved band used for holding, pressing, or connecting. When the retainer 1230 is engaging the cradle 1225, the ring 1415 may hold the rim 1215 to the base 1315. The ring 1415 may have an outer edge 1445, an inner edge 1450, a top surface 1455, and a bottom surface 1460. The ring 1415 may be perpendicular to the shaft 1435. The ring 1415 may be parallel to the collar 1405. The shaft 1435 may be integral with the outer edge 1445 or another portion of the top surface 1455.

The dimensions of the outer edge 1445 may be selected to be smaller than the opening 1320 of the flange 1305. The geometry of the outer edge 1445 may be circular or another shape. For example purposes, the outer edge 1445 may have a diameter of approximately 1" or other. The dimensions of the inner edge 1450 may be selected to be both larger than the circumference of the stem 1210 and smaller than the circumference of the rim 1215. The geometry of the inner edge 1450 may be circular or another shape. For example purposes, the inner edge 1450 may have a diameter of approximately 0.79" or other.

The inner edge 1450 may define an opening. During installation, the inner edge 1450 may pass around the electrical contact 1205 and the first section 1260 of the electric discharge lamp 1185. During installation, the bottom surface 1460 of the ring 1415 may contact the rim 1215. When the retainer 1230 engages the cradle 1225, the bottom surface 1460 of the ring 1415 may press the rim 1215 against the top surface 1360 of the base 1315.

Figure 13:
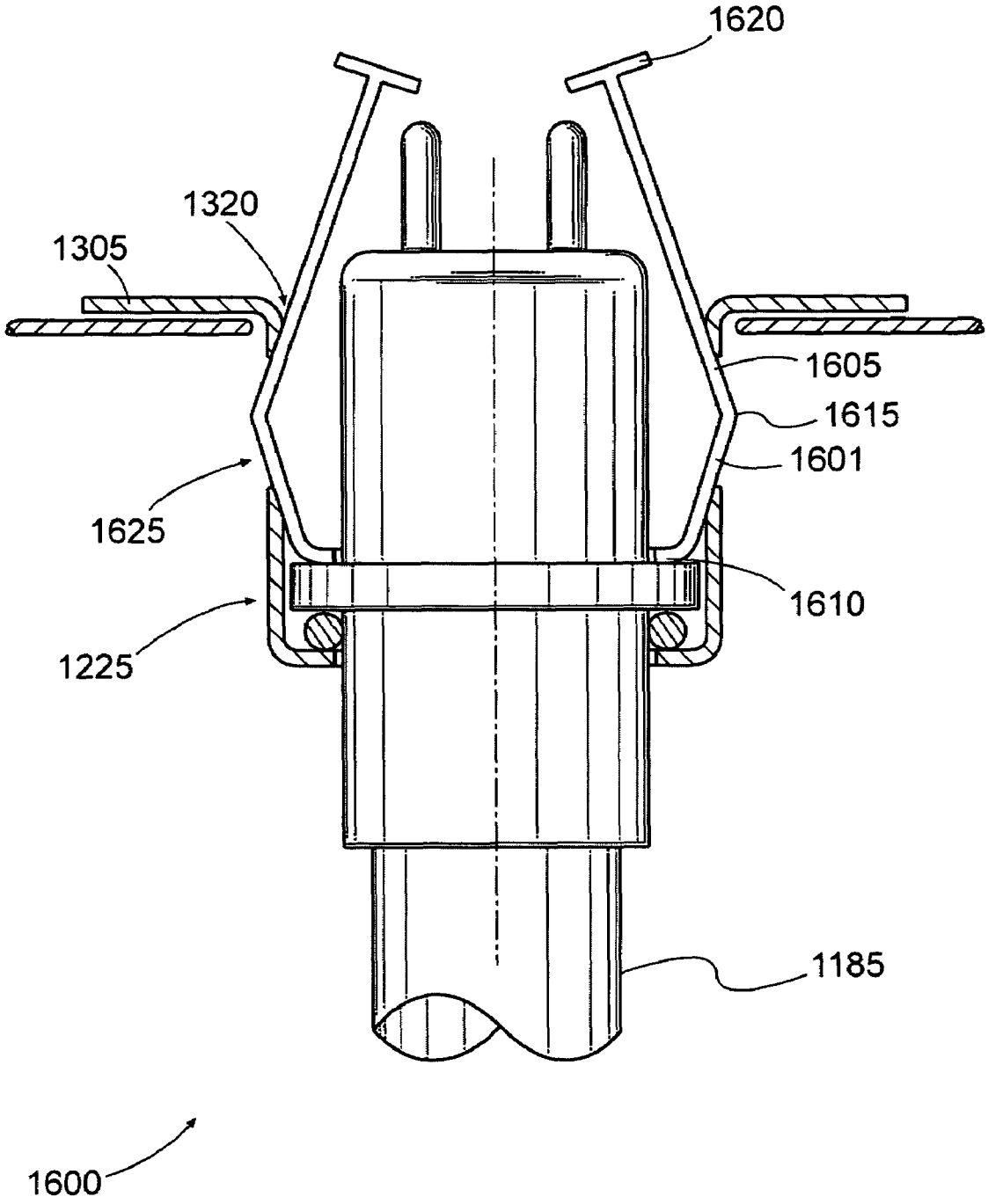
FIG. 13 is a cut-away perspective view of a mounting system.

Referring now to FIG. 13, there is shown a cut-away perspective view of a mounting system 1600. The mounting system 1600 may include a wall 1170, a cradle 1225, a retainer 1601, and an electric discharge lamp 1185. The retainer 1601 may include a cantilever 1605 and a ring 1610. The cantilever 1605 may be integral to the ring 1610. The cantilever 1605 may include a bend 1615 and tab 1620. The tab 1620 may function as a handling member. When the ring 1610 is inserted through the second opening 1325 of the flange 1305, the bend 1615 may engage a slit 1625 of the cantilever 1310 of the cradle 1225. Alternatively, the cantilever 1605 of the retainer 1601 may form a friction fit with the cantilever 1310 of the cradle 1225. The cantilever 1605 may be flexible such that an installer may squeeze the tab 1620 to disengage the bend 1615 from the cantilever 1310 of the cradle 1225.

When the electric discharge device 1185 is installed in the marine air conditioning system, the electric discharge device 1185 may be at least partially recessed beyond the wall 1170. When the electric discharge device 1185 is recessed, the electrical contact 1205 may protrude no more than ½" in length outside of the wall 1170. When the electric discharge device 1185 is recessed, the socket 1220 may protrude no more than ¾" in length outside of the wall 1170. Because the cradle 1225 and retainer 1230 may recess the electric discharge device 1185 at least partially beyond the wall 1170, the electrical contact 1205, the socket 1220 and the wiring (not shown) will not interfere with a wall 1150 of a duct of the marine air conditioning system.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

The invention claimed is:

1. A marine air conditioning system comprising:

a marine air conditioner comprising an evaporator coil including a surface a drain pan disposed below the evaporator coil a bracket attached to the marine air conditioner a germicidal lamp upstream of the evaporator coil receiving mechanical support from the bracket a recessed mount comprising a cradle comprising a flange, a cantilever and a base, the flange attached to the bracket and the base offset from the flange via the cantilever a retainer comprising a collar, a shaft and a ring, the ring offset from the collar via the shaft the ring securing a rim of the germicidal lamp to the base when the shaft is inserted through an opening of the flange wherein the germicidal lamp is adapted to emit ultraviolet radiation at a wavelength substantially at 253.7 nm towards the surface and the drain pan and generate an insignificant quantity or less of ozone.

2. The marine air conditioning system of claim 1 wherein the marine air conditioner further comprises a shroud partially enveloping the evaporator coil, the shroud disposed above the drain pan, wherein the bracket is attached to the shroud.

3. The marine air conditioning system of claim 1 wherein the bracket is attached to the drain pan.

4. The marine air conditioning system of claim 1 wherein the marine air conditioner further comprises a power supply disposed above the drain pan, wherein the bracket is attached to the power supply.

5. The marine air conditioning system of claim 1 further comprising a clasp attached to the bracket securing the germicidal lamp in relation to the bracket.

6. The marine air conditioning system of claim 5 wherein the clasp is selected from the group comprising a spring clamp, a sleeve, a hanger, a race, a locking clamp, a clip, a holster and a strap.

7. The marine air conditioning system of claim 1 further comprising a dampener for reducing an effect selected from the group comprising vibration and shock, the dampener abutting both the bracket and the marine air conditioner, wherein the dampener is selected from the group comprising a dampening sheet, a cushion pad, a bushing, a grommet, a washer, a spring, a shock, a bumper, a foam tape, a gasket and a dampening tape.

8. The marine air conditioning system of claim 5 further comprising a dampener for reducing an effect selected from the group comprising vibration and shock, the dampener abutting both the germicidal lamp and the clasp, the dampener selected from the group comprising a dampening sheet, a cushion pad, a bushing, a grommet, a washer, a spring, a shock, a bumper, a foam tape, a gasket and a dampening tape.

9. The marine air conditioning system of claim 1 wherein the bracket is attached to the marine air conditioner via a means selected from the group comprising a clamp, a fastener, an adhesive, a magnet and a welding.

10. The marine air conditioning system of claim 1 wherein the germicidal lamp is disposed relative to the evaporator coil at a distance approximately 25%-75% of the height of the evaporator coil.

11. The marine air conditioning system of claim 1, wherein the ring secures the rim of the germicidal lamp to the base when an edge of the collar is positioned below an ear of the flange.

12. A boat comprising a hull and the marine air conditioning system of claim 1.

13. A marine air conditioning system comprising:

a marine air conditioner comprising an evaporator coil including a surface a drain pan disposed below the evaporator coil a bracket that is an integral part of a shroud at least partially enveloping the evaporator coil a germicidal lamp upstream of the evaporator coil receiving mechanical support from the bracket a recessed mount comprising a cradle comprising a flange, a cantilever and a base, the flange attached to the bracket and the base offset from the flange via the cantilever a retainer comprising a collar, a shaft and a ring, the ring offset from the collar via the shaft the ring securing a rim of the germicidal lamp to the base when the shaft is inserted through an opening of the flange wherein the germicidal lamp is adapted to emit ultraviolet radiation at a wavelength substantially at 253.7 nm towards the surface and the drain pan and generate an insignificant quantity or less of ozone.

14. The marine air conditioning system of claim 13 wherein the marine air conditioner further comprises a shroud partially enveloping the evaporator coil, the shroud disposed above the drain pan, wherein the flange is integral with the shroud.

15. The marine air conditioning system of claim 13 wherein the flange is integral with the drain pan.

16. The marine air conditioning system of claim 13 wherein the marine air conditioner further comprises a power supply disposed above the drain pan, wherein the flange is integral with the power supply.

17. The marine air conditioning system of claim 13 further comprising a clasp attached to the flange securing the germicidal lamp in relation to the flange.

18. The marine air conditioning system of claim 17 wherein the clasp is selected from the group comprising a spring clamp, a sleeve, a hanger, a race, a locking clamp, a clip, a holster and a strap.

19. The marine air conditioning system of claim 17 further comprising a dampener for reducing an effect selected from the group comprising vibration and shock, the dampener abutting both the germicidal lamp and the clasp, the dampener selected from the group comprising a dampening sheet, a cushion pad, a bushing, a grommet, a washer, a spring, a shock, a bumper, a foam tape, a gasket and a dampening tape.

20. The marine air conditioning system of claim 13 wherein the germicidal lamp is disposed relative to the evaporator coil at a distance approximately 25%-75% of the height of the evaporator coil.

21. A boat comprising a hull and the marine air conditioning system of claim 13.

22. The marine air conditioning system of claim 13, wherein the ring secures the rim of the germicidal lamp to the base when an edge of the collar is positioned below an ear of the flange.

23. A process of cleaning and maintaining a marine air conditioner comprising:

providing a marine air conditioner comprising an evaporator coil including a surface a drain pan disposed below the evaporator coil providing a bracket attached to the marine air conditioner providing a germicidal lamp upstream of the evaporator coil, the germicidal lamp receiving mechanical support from the bracket providing a recessed mount comprising a cradle comprising a flange, a cantilever, and a base, the flange attached to the bracket and the base offset from the flange of the cradle via the cantilever a retainer comprising a collar, a shaft and a ring, the ring offset from the collar via the shaft the ring securing a rim of the germicidal lamp to the base when the shaft is inserted through an opening of the flange emitting ultraviolet radiation from the germicidal lamp at a wavelength substantially at 253.7 nm towards the surface and the drain pan while generating an insignificant quantity or less of ozone.

24. The process of cleaning and maintaining a marine air conditioner of claim 23 wherein the marine air conditioner further comprises a shroud partially enveloping the evaporator coil, the shroud disposed above the drain pan, wherein the bracket is attached to the shroud.

25. The process of cleaning and maintaining a marine air conditioner of claim 23 wherein the bracket is attached to the drain pan.

26. The process of cleaning and maintaining a marine air conditioner of claim 23 wherein the marine air conditioner further comprises a power supply disposed above the drain pan, wherein the bracket is attached to the power supply.

27. The process of cleaning and maintaining a marine air conditioner of claim 23 further comprising a clasp attached to the bracket securing the germicidal lamp in relation to the bracket.

28. The process of cleaning and maintaining a marine air conditioner of claim 27 wherein the clasp is selected from the group comprising a spring clamp, a sleeve, a hanger, a race, a locking clamp, a clip, a holster and a strap.

29. The process of cleaning and maintaining a marine air conditioner of claim 23 further comprising providing a dampener for reducing an effect selected from the group comprising vibration and shock, the dampener abutting both the bracket and the marine air conditioner, wherein the dampener is selected from the group comprising a dampening sheet, a cushion pad, a bushing, a grommet, a washer, a spring, a shock, a bumper, a foam tape, a gasket and a dampening tape.

30. The process of cleaning and maintaining a marine air conditioner of claim 27 further comprising providing a dampener for reducing an effect selected from the group comprising vibration and shock, the dampener abutting both the germicidal lamp and the clasp, the dampener selected from the group comprising a dampening sheet, a cushion pad, a bushing, a grommet, a washer, a spring, a shock, a bumper, a foam tape, a gasket and a dampening tape.

31. The process of cleaning and maintaining a marine air conditioner of claim 23 wherein the bracket is attached to the marine air conditioner via a means selected from the group comprising a clamp, a fastener, an adhesive, a magnet and a welding.

32. The process of cleaning and maintaining a marine air conditioner of claim 23 wherein the germicidal lamp is disposed relative to the evaporator coil at a distance approximately 25%-75% of the length of the evaporator coil.

33. The process of cleaning and maintaining a marine air conditioner of claim 23, wherein the ring secures the rim of the germicidal lamp to the base when an edge of the collar is positioned below an ear of the flange.

* * * * *